US008439525B2

(12) United States Patent
Abdelsamed et al.

(10) Patent No.: US 8,439,525 B2
(45) Date of Patent: May 14, 2013

(54) LUMINAIRES HAVING ENHANCED LIGHT DISTRIBUTION AND APPLICATIONS THEREOF

(75) Inventors: Yaser S. Abdelsamed, Granville, OH (US); Januk Aggarwal, New Albany, OH (US); John Bryan Harvey, Newark, OH (US)

(73) Assignee: ABL IP Holding LLC, Conyers, GA (US)

( * ) Notice: Subject to any disclaimer, the term of this patent is extended or adjusted under 35 U.S.C. 154(b) by 489 days.

(21) Appl. No.: 12/761,761

(22) Filed: Apr. 16, 2010

(65) Prior Publication Data

US 2010/0265719 A1 Oct. 21, 2010

Related U.S. Application Data

(63) Continuation-in-part of application No. 12/201,946, filed on Aug. 29, 2008, now abandoned.

(60) Provisional application No. 61/169,859, filed on Apr. 16, 2009.

(51) Int. Cl.
*F21V 7/00* (2006.01)

(52) U.S. Cl.
USPC ..... 362/297; 362/277; 362/296.01; 362/346

(58) Field of Classification Search ..... 362/277, 362/296.01, 296.07, 301, 302, 311.09, 330, 362/278–281, 346, 300, 350, 297
See application file for complete search history.

(56) References Cited

U.S. PATENT DOCUMENTS

| | | | | |
|---|---|---|---|---|
| 1,811,782 | A | 6/1931 | Duncan | |
| 1,888,995 | A | 11/1932 | Matter | |
| 2,981,827 | A | 4/1961 | Orsatti et al. | |
| 3,292,029 | A | 12/1966 | Chi et al. | |
| 3,329,812 | A * | 7/1967 | Harling | 362/223 |
| 3,701,896 | A | 10/1972 | Pate | |
| 3,886,347 | A | 5/1975 | Dorman | |
| 4,037,096 | A | 7/1977 | Brendgord et al. | |
| 4,096,555 | A * | 6/1978 | Lasker | 362/302 |
| 4,177,504 | A | 12/1979 | Henderson et al. | |
| 4,241,390 | A | 12/1980 | Markle et al. | |
| 4,261,029 | A | 4/1981 | Mousset | |
| 4,463,410 | A * | 7/1984 | Mori | 362/20 |
| 4,472,767 | A * | 9/1984 | Wenman | 362/302 |
| 4,544,999 | A | 10/1985 | Kawanami et al. | |

(Continued)

FOREIGN PATENT DOCUMENTS

| | | |
|---|---|---|
| CN | 1731011 | 2/2006 |
| EP | 365193 | 4/1990 |
| JP | 2007294356 | 11/2007 |

OTHER PUBLICATIONS

Non-Final Office Action for U.S. Appl. No. 12/201,946, mailed Apr. 14, 2010 (13 pages).

(Continued)

*Primary Examiner* — John A Ward
(74) *Attorney, Agent, or Firm* — Kilpatrick Townsend & Stockton LLP

(57) ABSTRACT

The present invention, in some embodiments, provides a luminaire operable to enhance the uniformity of light distributed from the luminaire thereby mitigating diminished illuminance at the periphery of an illuminated area.

22 Claims, 13 Drawing Sheets

U.S. PATENT DOCUMENTS

| | | | | |
|---|---|---|---|---|
| 4,739,152 | A | 4/1988 | Downs | |
| 4,775,619 | A * | 10/1988 | Urdea | 435/6.16 |
| 4,897,771 | A | 1/1990 | Parker | |
| 5,014,175 | A | 5/1991 | Osteen et al. | |
| 5,015,088 | A | 5/1991 | Rhomberg et al. | |
| 5,067,053 | A | 11/1991 | Akizuki | |
| 5,363,293 | A * | 11/1994 | Lasker | 362/302 |
| 5,676,455 | A * | 10/1997 | Johnson et al. | 362/301 |
| 5,791,768 | A | 8/1998 | Splane | |
| 5,795,057 | A | 8/1998 | Weigert | |
| 6,000,816 | A | 12/1999 | Serizawa et al. | |
| 6,033,093 | A * | 3/2000 | Latsis et al. | 362/304 |
| 6,068,388 | A | 5/2000 | Walker et al. | |
| RE36,908 | E | 10/2000 | Ling | |
| 6,244,729 | B1 | 6/2001 | Waldmann | |
| 6,273,590 | B1 | 8/2001 | Splane | |
| 6,282,027 | B1 | 8/2001 | Hough | |
| 6,543,910 | B2 | 4/2003 | Taniuchi et al. | |
| 6,572,246 | B1 | 6/2003 | Hopp et al. | |
| 6,698,908 | B2 | 3/2004 | Sitzema et al. | |
| 6,719,444 | B1 | 4/2004 | Alber et al. | |
| 6,783,261 | B2 | 8/2004 | Simon | |
| 6,874,914 | B2 | 4/2005 | Desanto et al. | |
| 6,910,791 | B2 | 6/2005 | Futami | |
| 7,055,991 | B2 | 6/2006 | Lin | |
| 7,121,704 | B2 | 10/2006 | Takada | |
| 7,160,002 | B2 | 1/2007 | Simon | |
| 7,213,944 | B2 | 5/2007 | Shimaoka et al. | |
| 7,213,948 | B2 | 5/2007 | Hein | |
| 7,244,049 | B2 | 7/2007 | Suzuki | |
| 7,244,050 | B2 | 7/2007 | Summerford et al. | |
| 7,387,409 | B1 * | 6/2008 | Beadle | 362/308 |
| 7,547,116 | B2 | 6/2009 | Walker et al. | |
| 7,614,767 | B2 * | 11/2009 | Zulim et al. | 362/296.01 |
| 2002/0075693 | A1 | 6/2002 | Rosenhahn et al. | |
| 2002/0105807 | A1 | 8/2002 | Loughrey | |
| 2004/0202004 | A1 | 10/2004 | Van Duyn | |
| 2005/0018434 | A1 | 1/2005 | Giuliano | |
| 2006/0262552 | A1 | 11/2006 | Komatsu et al. | |
| 2006/0291079 | A1 | 12/2006 | Beukert et al. | |
| 2007/0115679 | A1 | 5/2007 | Alcelik | |
| 2008/0037259 | A1 | 2/2008 | Walker et al. | |
| 2008/0266851 | A1 * | 10/2008 | Engel | 362/240 |

OTHER PUBLICATIONS

Amendment and Response for U.S. Appl. No. 12/201,946, mailed Jul. 14, 2010 (9 pages).

Non-Final Office Action for U.S. Appl. No. 12/201,946, mailed Oct. 14, 2010 (10 pages).

Amendment and Response for U.S. Appl. No. 12/201,946, filed Feb. 14, 2011 (16 pages).

Final Office Action for U.S. Appl. No. 12/201,946, mailed May 12, 2011 (11 pages).

Holophane RSL—200 Series, 4 pages, 2001.

New Light Solutions, Volume, Jan. 2006, WIIA, 24 pages.

Optical Design, Lighting Technologies Inc., 3 pages, 2006.

* cited by examiner

LUMINAIRES HAVING ENHANCED LIGHT DISTRIBUTION AND APPLICATIONS THEREOF

CROSS-REFERENCE TO RELATED APPLICATIONS

This application is a continuation-in-part of U.S. patent application Ser. No. 12/201,946, filed Aug. 29, 2008, and claims the benefit of U.S. Provisional Application No. 61/169,859, filed Apr. 16, 2009, the entirety of each of which is herein incorporated by reference.

FIELD OF THE INVENTION

The present invention relates to luminaires and, in particular, to luminaires used in outdoor lighting applications.

BACKGROUND OF THE INVENTION

Luminaires for providing general illumination to an area are well known and often used in outdoor lighting applications including roadway and sidewalk lighting, parking lot lighting, and residential area lighting. Luminaires having symmetric light distributions can comprise a light source disposed within an external optic, wherein the external optic is designed to provide the symmetric light distribution. In one architecture, for example, a luminaire can comprise a light source disposed within a bell-shaped external optic, wherein the bell-shaped external optic provides a symmetric distribution of light to an area.

In some applications, however, a higher degree of control over light distribution from a luminaire is desirable. In some roadway lighting applications, for example, it is desirable to use luminaires having asymmetrical light distributions operable to provide the roadway and shoulder areas with higher luminous intensity in comparison with non-roadway areas such as grassy medians. Moreover, in some residential outdoor area lighting applications, it is desirable to use luminaires having asymmetrical light distributions operable to mitigate or prevent light trespass.

Asymmetric light distributions from a luminaire can presently be created through several avenues. One avenue is to design an external optic operable to create an asymmetric light distribution when a light source is disposed within the external optic. Design of an external optic operable to provide an asymmetric light distribution, however, is often cost prohibitive due to time intensive design processes that can strain engineering resources. Moreover, the design of the external optic is usually restricted to addressing a particular lighting need thereby precluding use of the design in a variety of applications.

Another avenue for producing an asymmetric light distribution from a luminaire is to externally couple a secondary optic to a primary optic, wherein the secondary optic is responsible for creating the asymmetric light distribution. A reflective bell-shaped primary optic, for example, can have a refractive secondary optic coupled thereto, wherein the refractive secondary optic produces an asymmetric light distribution. Such an arrangement is illustrated in FIG. 1. As displayed in FIG. 1, a refractive secondary optic (102) is coupled to the bottom of a reflective primary optic (100). Creating an asymmetric light distribution with this architecture has significant disadvantages as the refractive secondary optic is likely to change the EPA wind loading of the luminaire while also increasing the weight of the luminaire. Furthermore, achieving designations such as IES Full-Cutoff becomes very difficult as the refractive secondary optic can cause uplight from the luminaire.

An additional avenue for producing an asymmetric light distribution from a luminaire is to block one or more portions of light from being transmitted by the luminaire. This avenue is disadvantageous since precluding portions of light from being transmitted by the luminaire reduces the luminous flux of the luminaire leading to inefficiencies and poor optical systems.

In addition to using asymmetric light distributions to focus the emitted light in desired directions and thus toward desired areas, it is also desirable that the illuminance of the light distribution from the luminaire (asymmetrical or otherwise) is uniform across the illuminated area. Traditionally, an external optic is designed such that the bottom section of a vertically oriented light source reflects at the highest desirable angle. A problem, however, arises with this construction when using high intensity discharge (HID) light sources. The luminance at the ends of an HID source are less than at other points along the source. As a result, the amount of high angle light provided by the luminaire is reduced, and light distribution from the luminaire is not as well-defined as desired. Ideally, the illuminance on the ground from a section of the external optic would be uniform across the illuminated area. A reduction in the amount of high angle light, nevertheless, diminishes illuminance as the edge of illuminated area is approached.

SUMMARY

Embodiments of the present invention provides luminaires operable to produce asymmetric light distributions without the foregoing structural, cost, and efficiency disadvantages. Moreover, such embodiments provide methods of providing an asymmetric light distribution to an area.

In one embodiment, a luminaire comprises a light source, an outer optic, and at least one inner optic at least partially positioned within the outer optic. The outer optic of the luminaire is adapted to direct a first portion of light received from the light source and a second portion of light received from the at least one inner optic resulting in an asymmetric light distribution from the luminaire. In some embodiments, an asymmetric light distribution comprises a radially asymmetric light distribution.

Any number of inner optics may be positioned at least partially within the outer optic. One or a plurality of inner optics may be retained at least partially within the outer optic via any retention method. In one embodiment one or more inner optics are at least partially positioned within the outer optic via a mounting bracket. The mounting bracket, in some embodiments, permits lateral, longitudinal, and/or radial adjustment of one or more inner optics. In this way, the relative positioning of the inner and outer optic is easily adjustable to permit tailoring the asymmetric light distribution of the luminaire. The ability to tailor the asymmetric light distribution of a luminaire can allow the luminaire to meet the requirements of a variety of applications without the cost considerations of having to redesign the luminaire for each intended application.

Other embodiments provide a luminaire operable to enhance the uniformity of light distributed from the luminaire thereby mitigating diminished illuminance at the periphery of an illuminated area. Mitigating diminished peripheral illuminance can permit further spacing between luminaires in lighting applications thereby lowering installation, energy and maintenance costs associated with lighting an area. In some embodiments, luminaires are operable to achieve enhanced light distribution by increasing the amount of high angle light provided by the luminaire without exceeding limits that would preclude meeting recommended industry standards.

An embodiment of a luminaire of the present invention comprises a light source, an outer optic, and at least a first and second inner optic at least partially disposed within the outer optic, wherein the first inner optic is adapted to direct light received from a point of maximum luminance of the light source to the bottom portion of the second inner optic, which in turn directs the light towards the outer optic and out of the luminaire. In some embodiments, providing light received from a point of maximum luminance of the light source to the bottom portion of the second inner optic increases the amount of high angle light distributed by the luminaire, thereby mitigating diminished illuminance at the periphery of an area illuminated by the luminaire.

In addition to providing luminaires, the present invention also provides methods of lighting a surface. In one embodiment, a method of lighting a surface comprises providing a luminaire comprising a light source, an outer optic, and at least a first and second inner optic at least partially disposed within the outer optic, directing light received from a point of maximum luminance of the light source by the first inner optic to the bottom portion of the second inner optic and directing the light from the bottom portion of the second inner optic to the outer optic and onto the surface.

These and other embodiments are presented in greater detail in the detailed description which follows.

DETAILED DESCRIPTION

Figure 1:
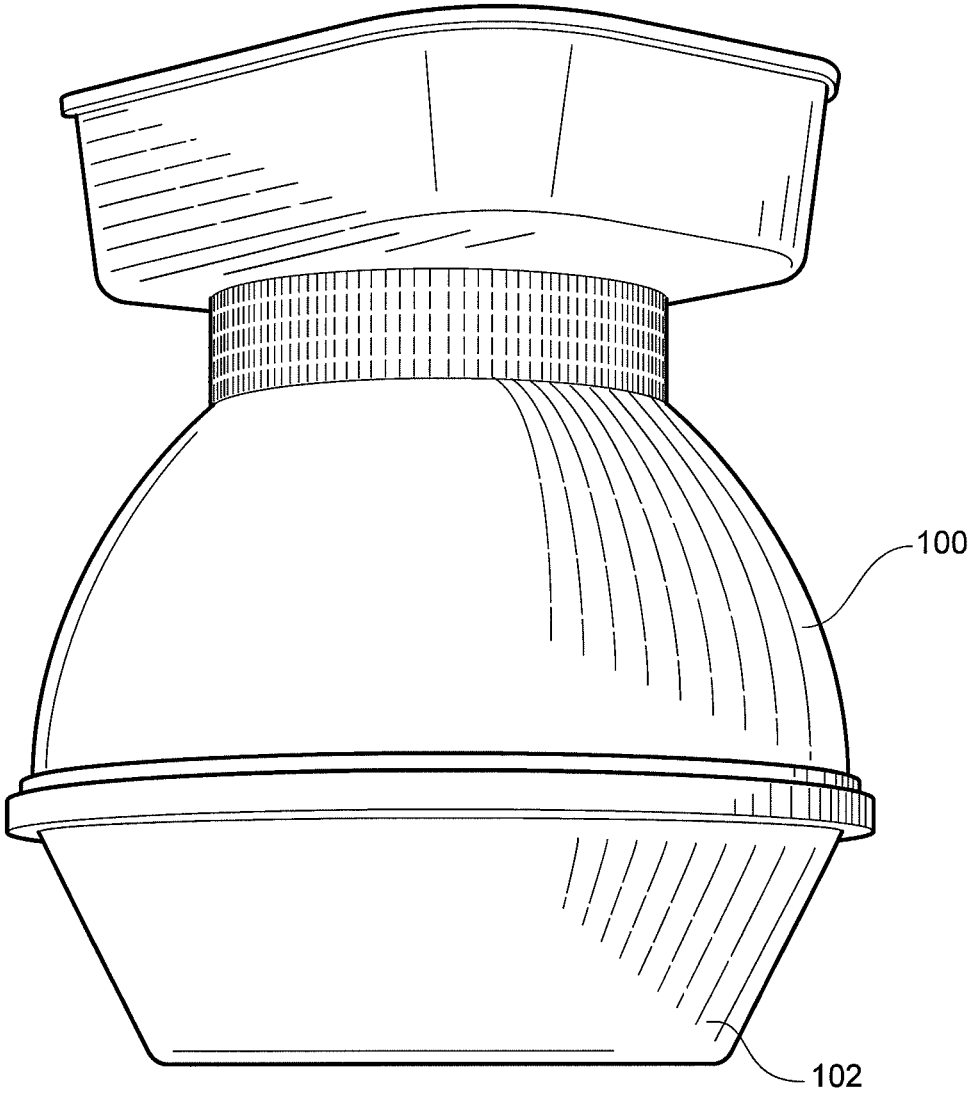
FIG. 1 illustrates a prior art luminaire having a secondary refractive optic externally coupled to a primary reflective optic.

Embodiments of the present invention can be understood more readily by reference to the following detailed description, examples, and drawings and their previous and following descriptions. However, apparatus and methods of the present invention are not limited to the specific embodiments presented in the detailed description, examples, and drawings. It should be recognized that these embodiments are merely illustrative of the principles of the present invention. Numerous modifications and adaptations thereof will be readily apparent to those of skill in the art without departing from the spirit and scope of the invention.

Some embodiments of the present invention provide luminaires operable to produce asymmetric light distributions without the structural, cost, and efficiency disadvantages associated with prior asymmetric lighting systems.

In one embodiment, the present invention provides a luminaire comprising a light source, an outer optic, and at least one inner optic at least partially positioned within the outer optic. The outer optic of the luminaire is adapted to direct a first portion of light received from the light source and a second portion of light received from the inner optic resulting in an asymmetric light distribution from the luminaire.

The outer optic works in conjunction with the inner optic to provide an asymmetric distribution of light from the luminaire. In one embodiment, the outer optic is adapted to direct light received from the at least one inner optic and light received directly from the light source in a longitudinal or substantially longitudinal direction. In directing light in a longitudinal or substantially longitudinal direction, the outer optic, in some embodiments, directs light out of the luminaire. Moreover, the at least one inner optic, in some embodiments, is adapted to direct light received from the light source in a transverse or substantially transverse direction. In directing light in a transverse or substantially transverse direction, an inner optic is operable to provide light received from the light source to the outer optic.

As provided herein, in some embodiments, a plurality of inner optics are at least partially positioned within the outer optic. In some embodiments, for example, a luminaire comprises two, three, four, five, six, seven, or eight inner optics.

In some embodiments of a luminaire of the present invention, the at least one inner optic is adjustable. In one embodiment, for example, the at least one inner optic is longitudinally adjustable. In another embodiment, the at least one inner optic is laterally adjustable. In a further embodiment, the at least one inner optic is radially adjustable.

In some embodiments wherein a plurality of inner optics are present, the inner optics are laterally, longitudinally, and/or radially adjustable independent of one another. In other embodiments, the plurality of inner optics are not independently adjustable and adjust in concert with one another. Adjustable inner optics, in some embodiments, permit tailoring the asymmetric light distribution of luminaires of the present invention. The ability to tailor the asymmetric light distribution of a luminaire of the present invention can allow the luminaire to meet the requirements of a variety of applications without the cost considerations of having to redesign the luminaire for each intended application.

In some embodiments, an inner optic has a V-shaped structure wherein the inner optic is bent at an angle $\theta$. In some embodiments, $\theta$ is greater than about 90°. In some embodiments, $\theta$ is less than about 90°. In another embodiment, an inner optic has a curved structure. In one embodiment, an inner optic comprises an arc having a central angle of less than about 180°, less than about 90° or less than about 60°. In another embodiment, an inner optic comprises an arc having a central angle greater than 180°.

Figure 2:
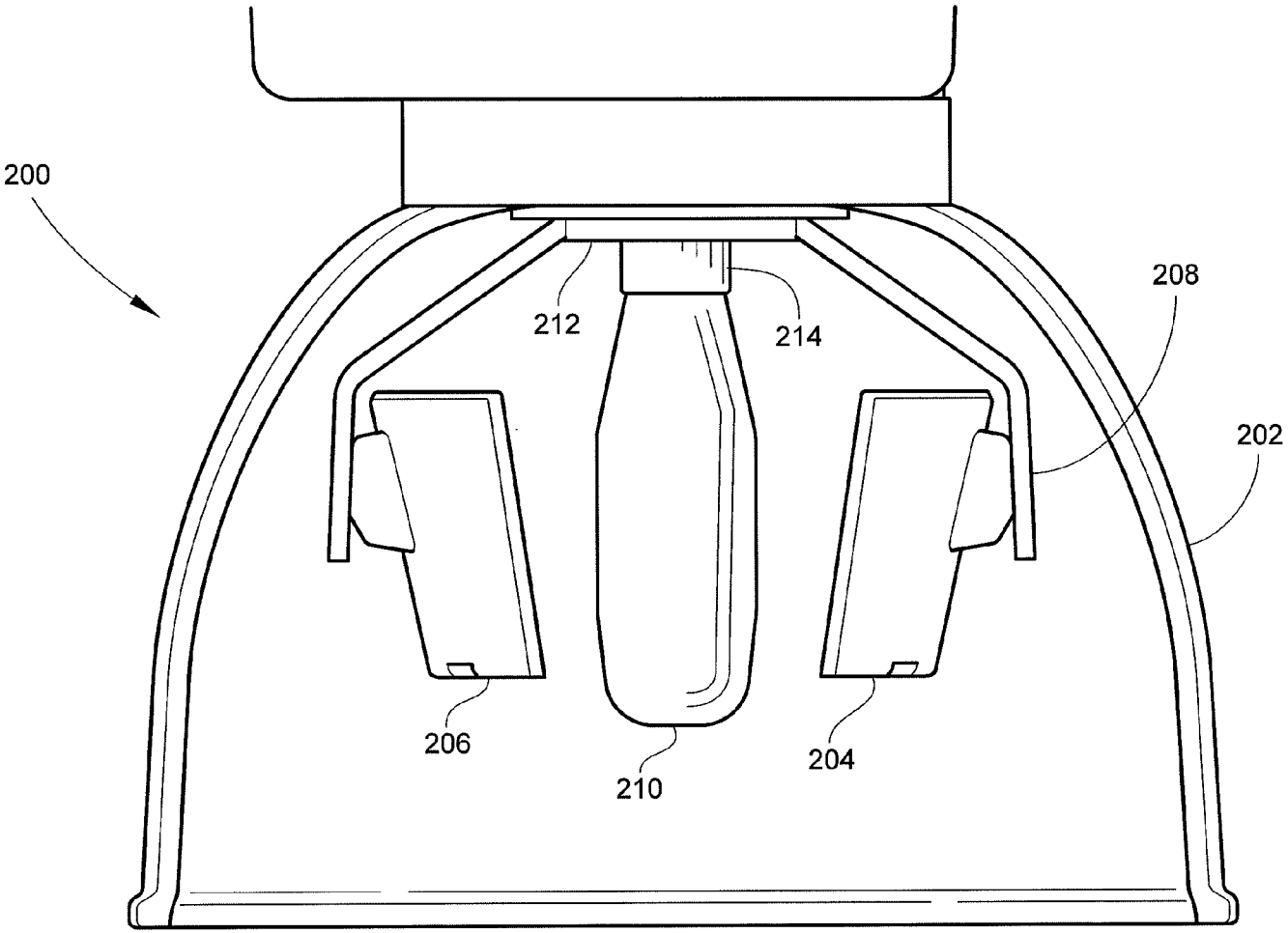
FIG. 2 is an elevational cut away view of a luminaire according to one embodiment of the present invention wherein a plurality of inner optics are disposed within the outer optic.

Referring now to the figures wherein like numerals indicate like elements throughout the various figures, FIG. 2 illustrates an elevational cut away view of a luminaire according to one embodiment of the present invention wherein a plurality of inner optics are disposed within an outer optic. As illustrated in a FIG. 2, the luminaire (200) comprises a bell-shaped reflective outer optic (202) having a plurality of reflective inner optics (204, 206) positioned within the outer optic (202). In the embodiment illustrated in FIG. 2, the inner optics (204, 206) are positioned fully within the outer optic (202), however they need not be positioned entirely within the outer optic (202). The reflective inner optics (204, 206) are coupled to a mounting bracket (208) for orientation around the light source (210). As provided herein, in some embodiments, the mounting bracket (208) comprises a collar (212) which surrounds the socket (214) of the light source (210) and secures to the base of the outer optic (202).

Figure 5:
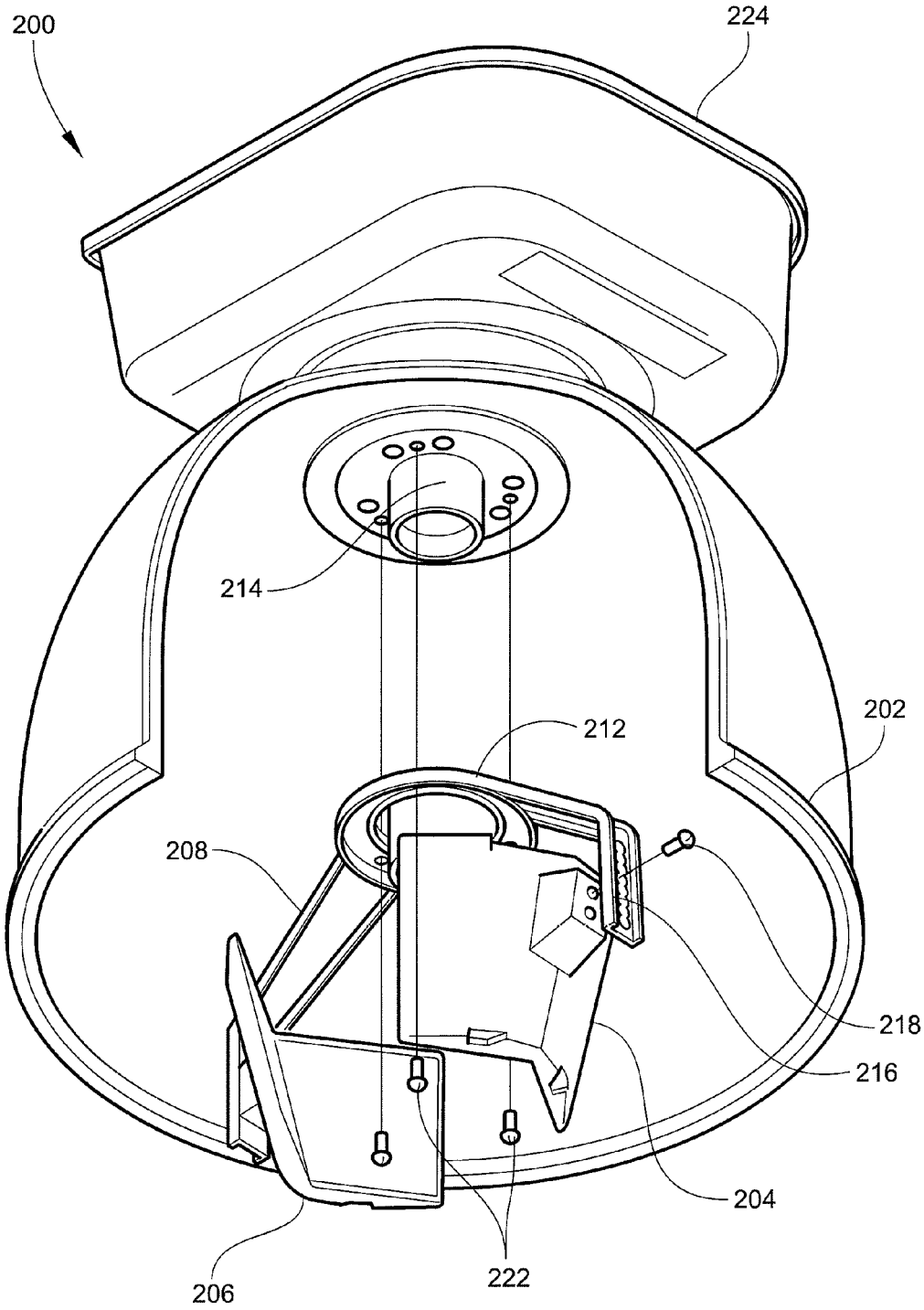
FIG. 5 is an exploded cut away view of the luminaire of FIG. 2.

As illustrated in FIG. 5, the mounting bracket (208) couples to the outer optic (202) and the base (224) of the luminaire (200) through a plurality of bolts or screws (222). Moreover, each inner optic (204, 206) couples to the mounting bracket (208) through a bolt or screw (218). The bolt or screw (218) is inserted in one of the longitudinal settings of the slot (216) in the mounting bracket (208) to place the inner optic (204, 206) in the proper position for producing a desired asymmetric light distribution in conjunction with the outer optic (202) as described herein.

Figure 3:
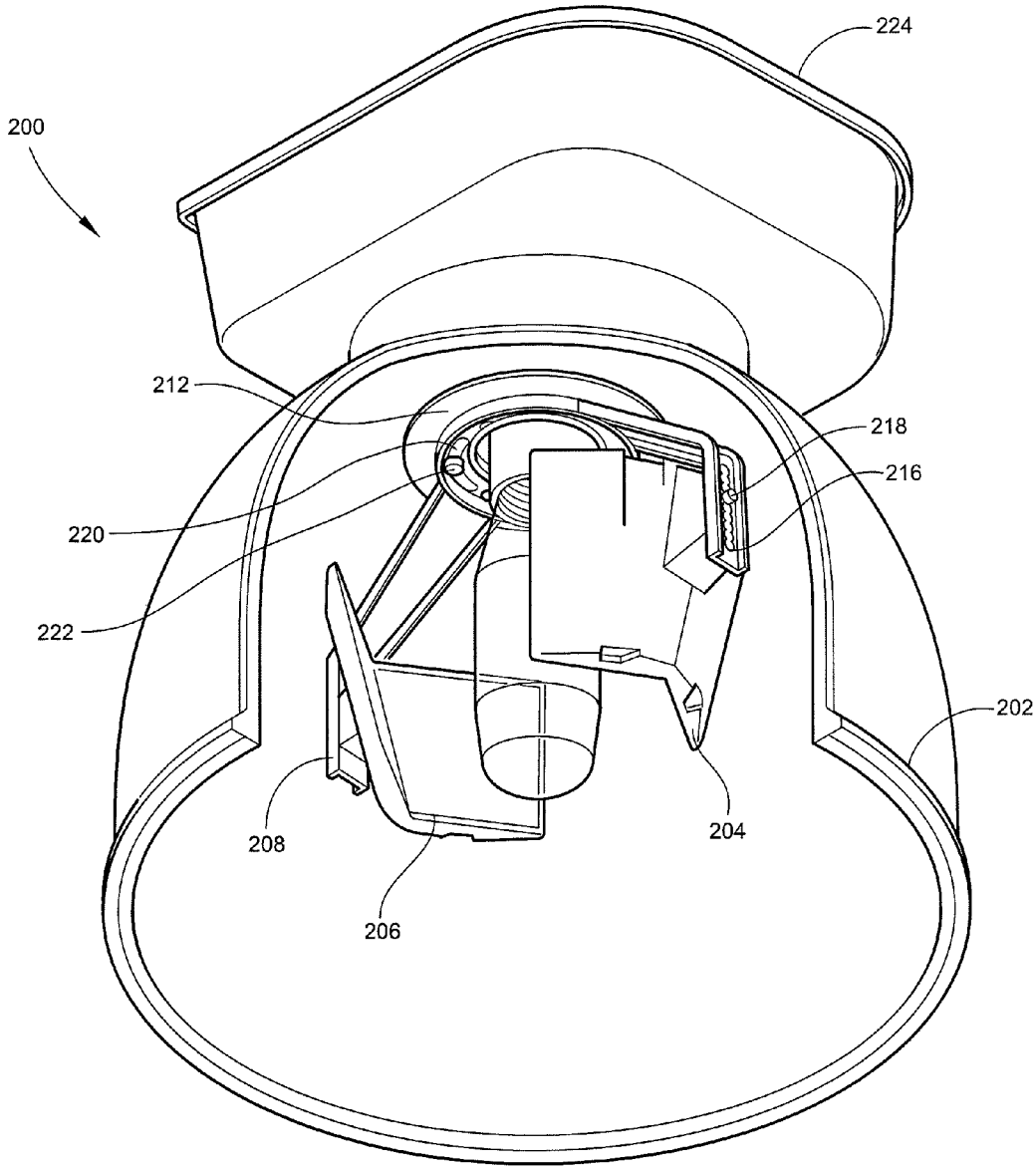
FIG. 3 is a perspective cut away view of the luminaire of FIG. 2.

FIG. 3 illustrates a perspective cut away view of the luminaire (200). The reflective inner optics (204, 206) may be longitudinally and/or laterally adjustable on the mounting bracket (208). As illustrated in FIG. 3, the mounting bracket (208) may comprise vertical slots (216) for coupling each inner optic (204, 206) to the mounting bracket (208) with a bolt or screw (218). Each vertical slot (216) displayed in FIG. 3 has a plurality of positions or settings for longitudinal adjustment of the inner optics (204, 206). Moreover, in some embodiments, the mounting bracket (208) comprises lateral slots (not shown) comprising a plurality of positions or settings for lateral adjustment of the inner optics (204, 206).

In addition to facilitating longitudinal and/or lateral adjustment of the inner optics (204, 206), the mounting bracket (208) is operable to rotate. The collar (212) of the mounting bracket (208), for example, can comprise radial slots (220) permitting rotation of the mounting bracket (208). In one embodiment, bolts or screws (222) coupling the collar (212) to the base of the outer optic (202) and the base (224) of the luminaire (200) can be loosened and the mounting bracket (208) rotated to a desired position, the radial slots passing around the loosened bolts or screws (222) during rotation. After the desired position is achieved, the bolts or screws (222) are tightened to secure the collar (212).

In an alternative embodiment, the bolts or screws (222) can be removed and the mounting bracket (208) rotated to a new position and the bolts or screws (222) reinserted into a new position. In order to facilitate such an embodiment, the base of the outer optic (202) and the base (224) of the luminaire can have a plurality of bolt or screw (222) insertion points. As provided herein, rotation of the collar (212) results in radial adjustment of the inner optics (204, 206).

While the inner optics may be laterally, longitudinally, and/or radially adjustable independent of one another, they do not need to be independently adjustable but rather can adjust in concert with one another. Adjustable inner optics, while not required, permit tailoring the asymmetric light distribution of luminaires. The ability to tailor the asymmetric light distribution of a luminaire can allow the luminaire to meet the requirements of a variety of applications without the cost considerations of having to redesign the luminaire for each intended application.

While use of mechanical fasteners are disclosed for retaining the inner optics (204, 206) in position relative to the outer optic (202), the invention is not so limited. Rather, any retention method may be used, including, but not limited to, use of mechanical fasteners, interference fit, mechanical interlock, etc. Moreover, while the figures illustrate two inner optics (204, 206), any number of inner optics may be provided, depending on the desired light distribution. Furthermore, the geometry of the inner optics (204, 206) can be, but need not be, identical.

Figure 4:
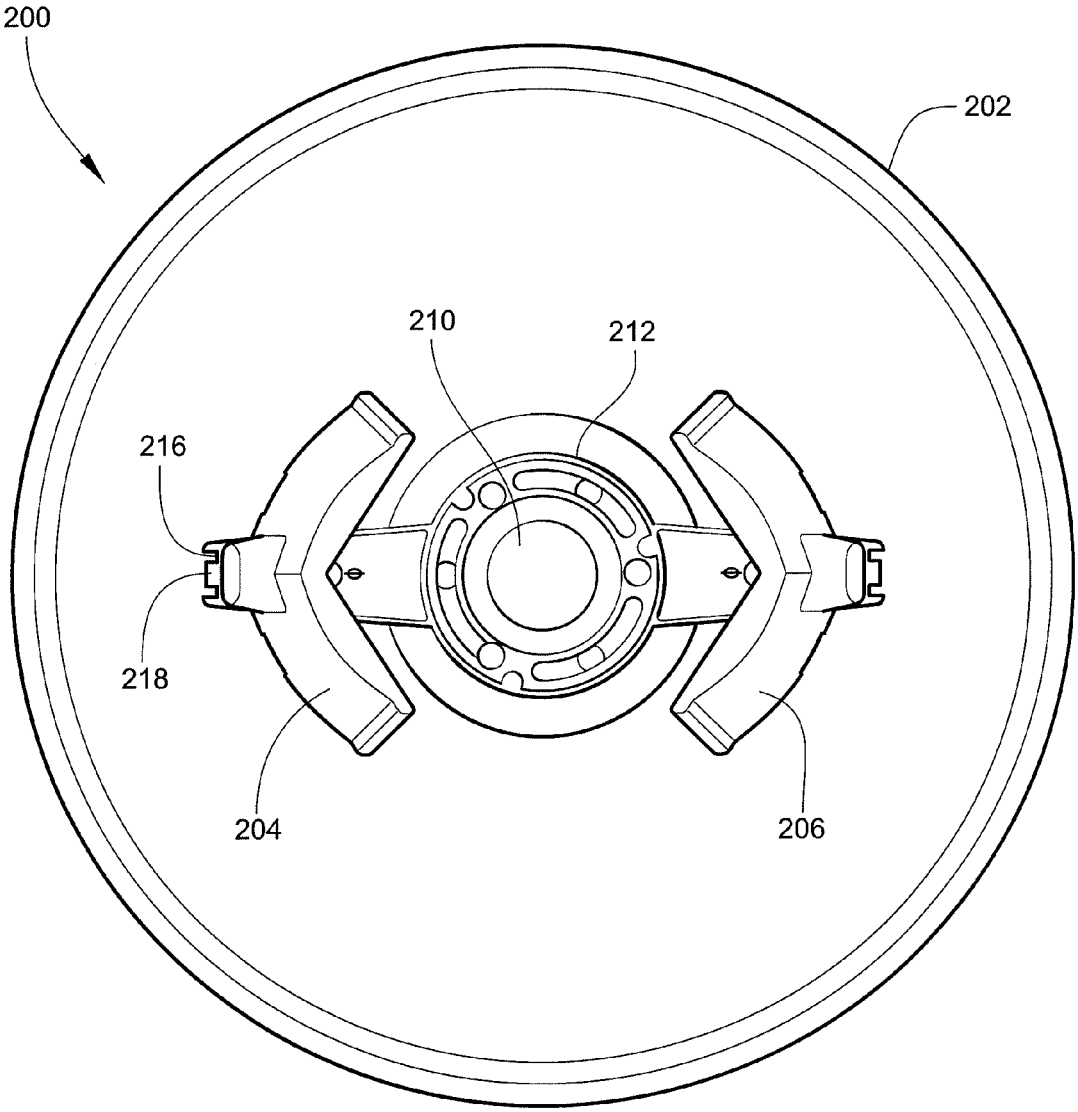
FIG. 4 is a bottom plan view of the luminaire of FIG. 2.

FIG. 4 displays a bottom plan view of the luminaire (200) according to one embodiment of the present invention. The inner optics (204, 206) positioned within the outer optic (202) surround up to about 180° of the circumference of the light source (210). In some embodiments, one or a plurality of inner optics surround less than about 180° of the circumference of the light source. In other embodiments, one or a plurality of inner optics surround less than about 120° or less than about 90° of the circumference of the light source. In another embodiment, one or a plurality of inner optics surround less than about 60° or less than about 30° of the circumference of the light source. In a further embodiment, one or a plurality of inner optics surround greater than about 180° of the circumference of the light source.

Moreover, the inner optics (204, 206) demonstrate one embodiment of a V-shaped structure, bent at an angle θ as provided herein. While V-shaped inner optics are illustrated in FIG. 4, inner optics having any shape tailored to reflect or refract light as desired are contemplated by the present invention. For example, linear or curved inner optics may be suitable in some applications. In one embodiment, an inner optic comprises an arc having a central angle of less than about 180°, less than about 90° or less than about 60°. In another embodiment, an inner optic comprises an arc having a central angle greater than 180°.

An inner optic, in some embodiments, comprises a reflector, refractor, or combinations thereof. In some embodiments wherein a plurality of inner optics are present, the inner optics are constructed independently of one another. In one embodiment, for example, a first inner optic is a reflector and a second inner optic is a refractor. In another embodiment, a first inner optic is a reflector and a second inner optic is a reflector. Embodiments of the present invention contemplate any combination of reflector and refractor inner optics operable to achieve asymmetric light distributions in conjunction with the outer optic.

An outer optic of a luminaire of the present invention can comprise a reflector, a refractor, or a combination thereof. In some embodiments, wherein the outer optic is a reflector, the luminaire does not produce any significant uplighting and can achieve an IES Full-Cutoff designation. While the outer optic (202) illustrated in the figures is bell-shaped, it can be of any desired shape including, but not limited to, parabolic, spherical, or elliptical.

Figure 6:
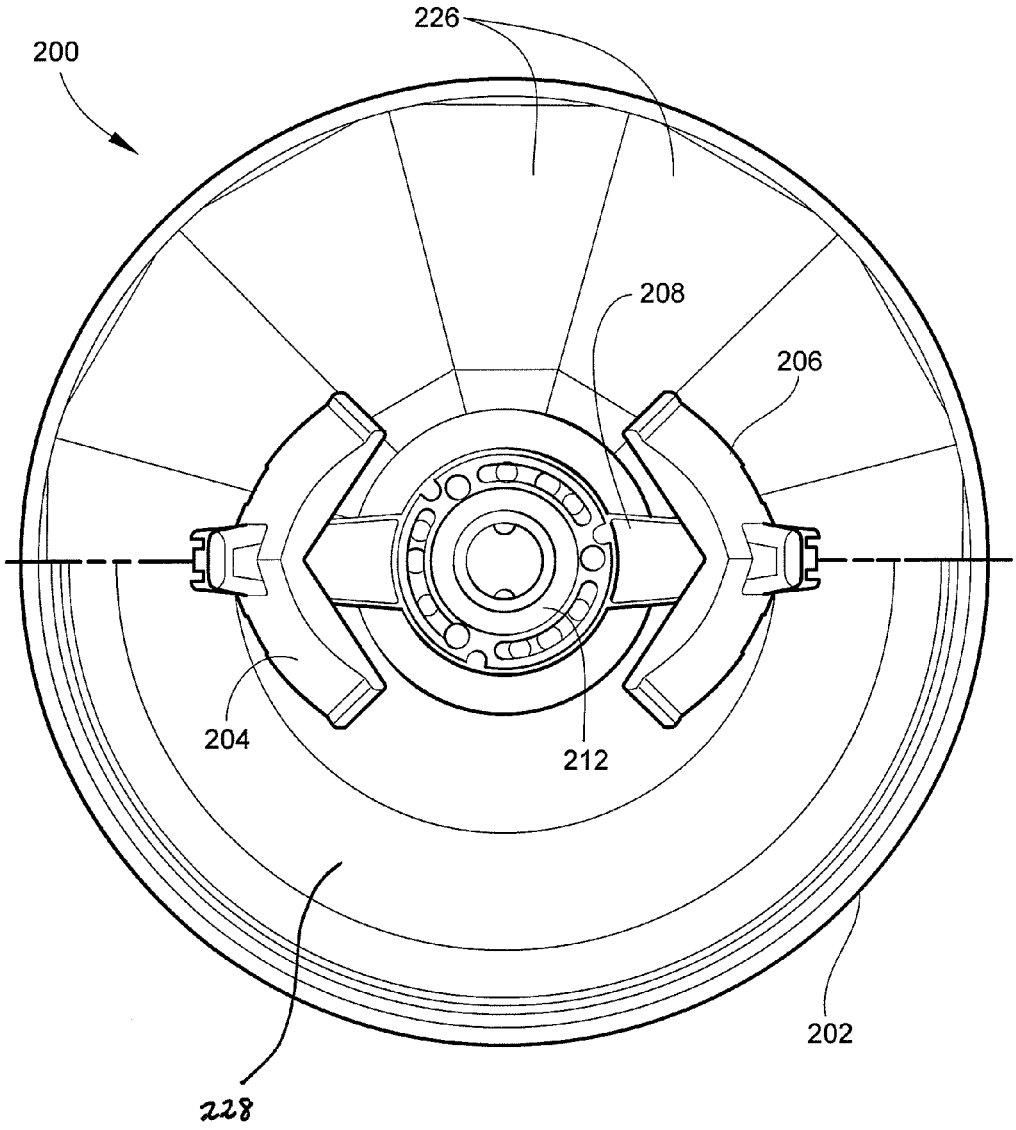
FIG. 6 is a bottom plan view of a luminaire according to one embodiment of the present invention.

FIG. 6 illustrates an outer optic (202) having an interior surface formed of a plurality of concave panels (226). The continuous reflective surface comprising a plurality of concave panels (226) has been partially cut away to reveal the shell (228) of the outer optic (202) underlying the plurality of concave panels (226). In some embodiments, each of the plurality of concave panels (226) has a wedge shape.

In some embodiments and as illustrated in FIGS. 1-6, a luminaire of the present invention has an open design wherein a protective lens does not enclose or seal the interior of the outer optic from the outside or ambient environment. An open, flow through design can assist in precluding or inhibiting the build up of dirt within the luminaire thereby permitting the luminaire to demonstrate an advantageous luminaire dirt depreciation factor (LDD). In other embodiments, a luminaire of the present invention comprises a protective lens which encloses or seals the interior of the outer optic from the outside environment.

In some embodiments, wherein the luminaire has an open design, the outer optic and/or at least one inner optic comprise a radiation transmissive protective covering. In one embodiment, for example, a reflective outer optic comprises a radiation transmissive protective covering over the interior reflective surface of the outer optic. In some embodiments described herein, the interior reflective surface comprises specular enhanced aluminum panels hermetically sealed between the shell of the outer optic and a protective cover such glass, including but not limited to, borosilicate glass. In some embodiments, protective constructions for interior reflective surfaces of the outer optic comprise those provided in U.S. patent application Ser. No. 11/623,487 which is hereby incorporated by reference in its entirety.

Moreover, in another embodiment, a reflective inner optic comprises a protective covering over the reflective surface of the inner optic. Protective coverings for inner and outer optics of the present invention can comprise any material that does not substantially impair the ability of the inner and outer optics to perform their intended functions. In some embodiments, a protective covering comprises glass or polymeric materials. In one embodiment, a glass suitable for a protective covering comprises borosilicate glass.

Reflective inner and outer optics of the present invention can comprise any reflective material known to those of skill in the art as being suitable for use in reflective optics. In one embodiment, a reflective material for use in inner and outer optics of the present invention comprises polished metals such as, but not limited to, polished aluminum. In some embodiments a reflective material for use in inner and outer optics of the present invention comprises MIRO 4. In some embodiments, the reflectivity of inner and outer optics can be further enhanced by the application of reflective coatings, including reflective paints, or other reflective compositions.

Moreover, refractive inner and outer optics of the present invention can comprise any refractive material suitable for directing light in a manner consistent with embodiments described herein. In some embodiments, a refractive optic comprises a biconvex lens, a planoconvex lens, a planoconcave lens, or a biconcave lens. In other embodiments, a refractive optic comprises a positive meniscus lens or a negative meniscus lens. In some embodiments, a refractive optic comprises one or a plurality of prismatic structures. In one embodiment, a prismatic structure comprises Fresnel prisms. In some embodiments, one or a plurality of prismatic structures are present on at least one surface of an inner and/or outer optic.

Additionally, luminaires of the present contemplate any suitable light source known to one of skill in the art. In some embodiments, a light source comprises a HID lamp including metal halide lamps, high pressure sodium lamps, and mercury vapor lamps. In some embodiments, a HID lamp has any wattage up to 1000 W. In other embodiments, a HID lamp has a wattage greater than 1000 W. In another embodiment, a light source comprises a compact fluorescent lamp. In some embodiments, a compact fluorescent lamp has a wattage of 32 W, 42 W or 57 W.

Figure 7:
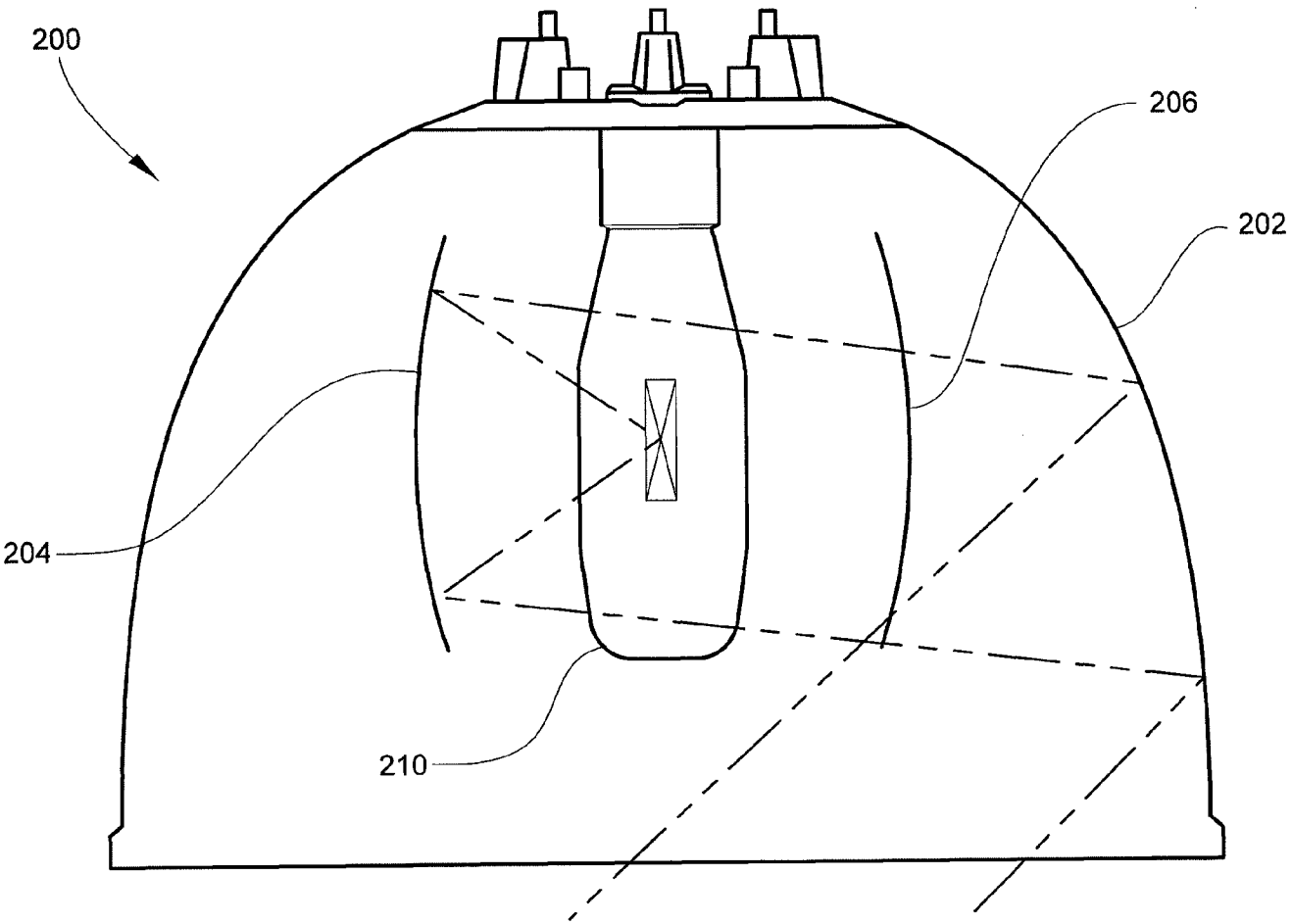
FIG. 7 is an elevational cut away view of a luminaire illustrating an inner optic directing light to an outer optic for providing an asymmetric light distribution from the luminaire according to one embodiment of the present invention.

Referring once again to the figures, FIG. 7 is an elevational cut away view of the luminaire (200) illustrating an inner optic (204) directing light to the outer optic (202) for providing an asymmetric light distribution from the luminaire (200) according to one embodiment of the present invention. For purposes of clarity in FIGS. 7 and 8, light received and directed by the inner optic (206) is not illustrated. Moreover, light received directly from the light source (210) by the outer optic (202) and subsequently directed by the outer optic (202) is also not shown.

As illustrated in FIG. 7, the inner optic (204) directs light from the light source (210) to the outer optic (202) for reflection out of the luminaire. In order to work in conjunction with the outer optic (202) to provide an asymmetric light distribution, the inner optic, in some embodiments, is adapted to direct light from the light source (210) in a transverse or substantially transverse direction. Moreover, the outer optic (202) is adapted to direct light received from the inner optic (204) and light received directly from the light source (210) (not shown) in a longitudinal or substantially direction out of the luminaire (200).

Figure 8:
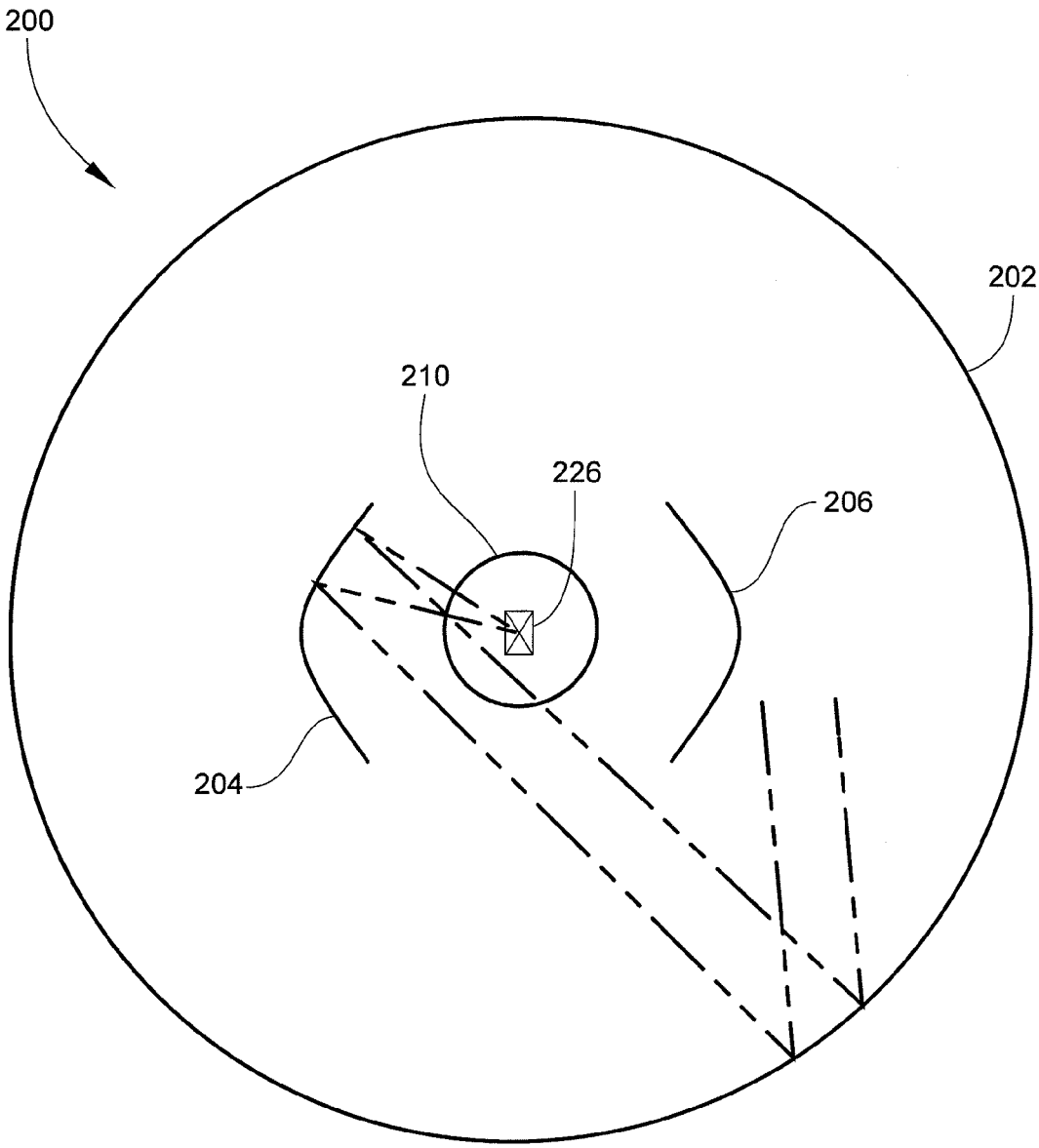
FIG. 8 is a top cut away view of the luminaire of FIG. 7 illustrating an inner optic directing light to the outer optic for providing an asymmetric light distribution from the luminaire according to one embodiment of the present invention.

FIG. 8 is a top cut away view of the luminaire (200) of FIG. 7 and illustrates inner optic (204) directing light to the outer optic (202) for providing an asymmetric light distribution from the luminaire (200) according to one embodiment of the present invention. In providing light from the light source to the outer optic, in some embodiments, the inner optic does not direct light back through the light source. In one embodiment, for example, the at least one inner optic does not direct light back through the arc tube of a high intensity discharge (HID) lamp, such as a metal halide lamp, high pressure sodium (HPS) lamp, or a mercury vapor lamp. Directing light back through the arc tube of a HPS lamp with an inner optic, for example, can lead to voltage rises that degrade lamp lifetime. Thus, in some embodiments, such as the ones shown in FIGS. 7 and 8, an inner optic (204) does not direct light from the light source (210) back through the arc tube (226) of the light source (210). A portion of light directed from the inner optic (204) can, but does not have to, pass through the envelope of the light source (210), as shown in FIG. 8.

As provided herein, in some embodiments, an inner optic comprises a continuous reflective surface. In some embodiments, the reflective surface of an inner optic has one or more creases or bends operable to reduce or preclude light normal to the inner optic from being directed back through the arc tube of a light source comprising a HID lamp. In some embodiments, for example, the reflective surface of an inner optic have a V-shaped structure being bent at and angle $\theta$ as described herein.

Figure 9:
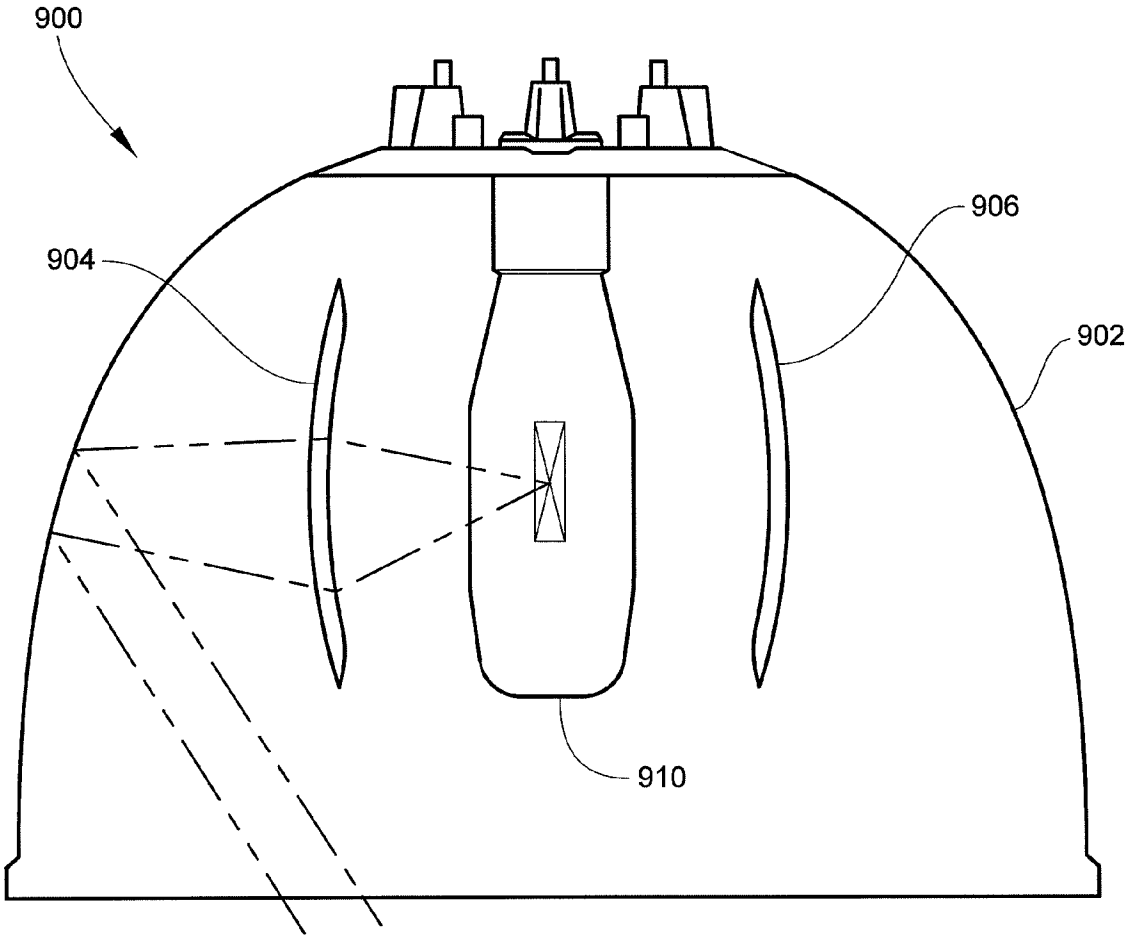
FIG. 9 is an elevational cut away view of a luminaire demonstrating refraction of light from the light source by an inner optic and subsequent reflection of the light by the outer optic according to one embodiment of the present invention.

FIG. 9 is an elevational cut away view of a luminaire (900) demonstrating refraction of light from the light source (910) by a refractive inner optic (904) and subsequent reflection of the light by the outer optic (902) to provide an asymmetric light distribution according to one embodiment of the present invention. For purposed of clarity, light refracted by inner optic (906) is not shown. Moreover, light received directly from the light source (910) by the outer optic (902) and subsequently directed by the outer optic (902) is also not shown.

As demonstrated in FIGS. 7 through 9, luminaires, according to some embodiments of the present invention, provide an asymmetric light distribution without the use of shields or other light blocking apparatus. As a result, luminaires of the present invention are operable to overcome the lighting inefficiencies of prior lighting systems which use shields to produce an asymmetric distribution of light.

In addition to providing luminaires, the present invention also provides methods of lighting a surface. In one embodiment, a method of lighting a surface comprises providing a luminaire comprising a light source, an outer optic, and at least one inner optic at least partially positioned within the outer optic, directing to the surface a first portion of light from the light source with the outer optic, and directing to the surface a second portion of light from the light source with the inner optic and the outer optic, wherein at least one of the first portion of directed light and the second portion of directed light is asymmetrically distributed over the surface. In some embodiments, a surface comprises a roadway, sidewalk, parking lot, athletic field or residential area. In another embodiment, a surface comprises an indoor or outdoor work area.

In another embodiment, the present invention provides a method of changing the asymmetric light distribution of a luminaire on a surface. In one embodiment, a method of changing the asymmetric light distribution of a luminaire on a surface comprises providing a luminaire comprising a light source, an outer optic, and at least one inner optic at least partially positioned within the outer optic, adjusting the at least one inner optic, directing to the surface a first portion of light from the light source with the outer optic, and directing to the surface a second portion of light from the light source with the inner optic and the outer optic, wherein at least one on the first portion of directed light and the second portion of directed light is asymmetrically distributed over the surface.

In some embodiments, adjusting the at least one inner optic comprises longitudinally adjusting the inner optic. In another embodiment, adjusting the at least one inner optic comprises laterally adjusting the inner optic. In a further embodiment, adjusting the at least one inner optic comprises radially adjusting the inner optic. In one embodiment, adjusting the at least one inner optic comprises a combination of longitudinal, lateral, and or radial adjustment.

Other embodiments provide a luminaire operable to enhance the uniformity of light distributed from the luminaire, thereby mitigating diminished illuminance at the periphery of an illuminated area. Mitigating diminished peripheral illuminance can permit further spacing between luminaires of the present invention in lighting applications thereby lowering installation, energy and maintenance costs associated with lighting an area. In some embodiments, luminaires are operable to achieve enhanced light distribution by increasing the amount of high angle light provided by the luminaire without exceeding limits that would preclude meeting recommended industry standards. High angle light is intended to cover light emitted from the luminaire at an angle of at least 60° off of the nadir.

In some embodiments, a luminaire of the present invention comprises a light source, an outer optic, and at least a first and second inner optic at least partially disposed within the outer optic. The first inner optic is adapted to direct light received from a point of maximum luminance of the light source to the bottom portion of the second inner optic, which, in turn, directs the light toward the outer optic and out of the luminaire. In some embodiments, providing light received from a point of maximum luminance of the light source to the bottom portion of the second inner optic increases the amount of high angle light distributed by the second inner optic thereby mitigating diminished illuminance at the periphery of an area illuminated by the luminaire.

Figure 10:
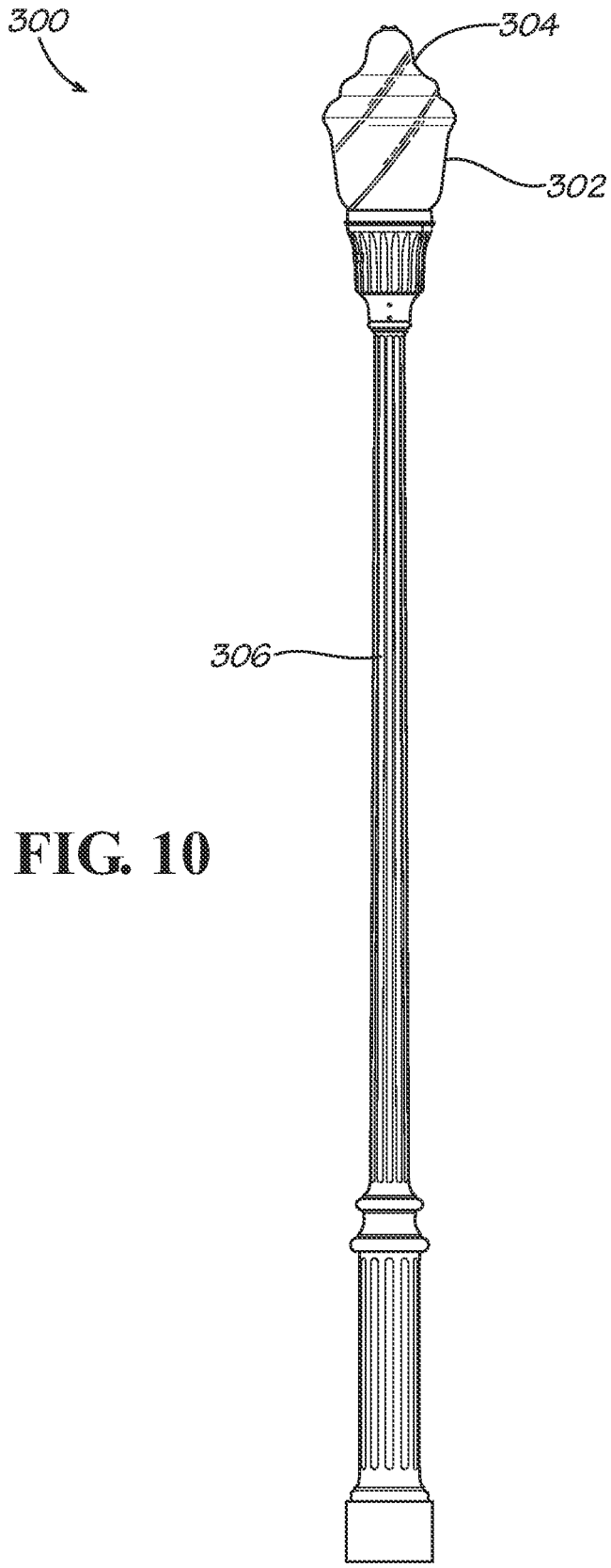
FIG. 10 is a side elevation view of an alternative embodiment of a luminaire of the present invention.

Some embodiments are for use in a post top luminaire (300), as shown in FIG. 10. One of skill in the art will readily understand, however, that the optics disclosed herein may be used in other types of luminaire. The luminaire generally includes a body/outer optic (302) (referred to hereinafter as the "outer optic") and a top (304) mounted on a post (306). A light source (308) is mounted within the luminaire on a socket (309). The outer optic (302) is preferably a refractor formed of glass or polymer. In one embodiment, the outer optic (302) is a refractor formed of prisms that spread light in primarily the horizontal direction without substantially altering the vertical directionality of the light. In some embodiments, the top (304) is formed of plastic or glass and acts as a refractor as well. In other embodiments, the top (304) is formed of an opaque material such that no light or substantially no light escapes from the top (304) of the luminaire (300).

At least two inner optics, first inner optic (310) and second inner optic (312), are provided within the outer optic (302). The first and second inner optics (310, 312) are provided in the luminaire (300) such that the first inner optic (310) is preferably positioned to direct light received from a point of maximum luminance of the light source (308) towards the bottom portion (314) of the second inner optic (312).

Figure 11:
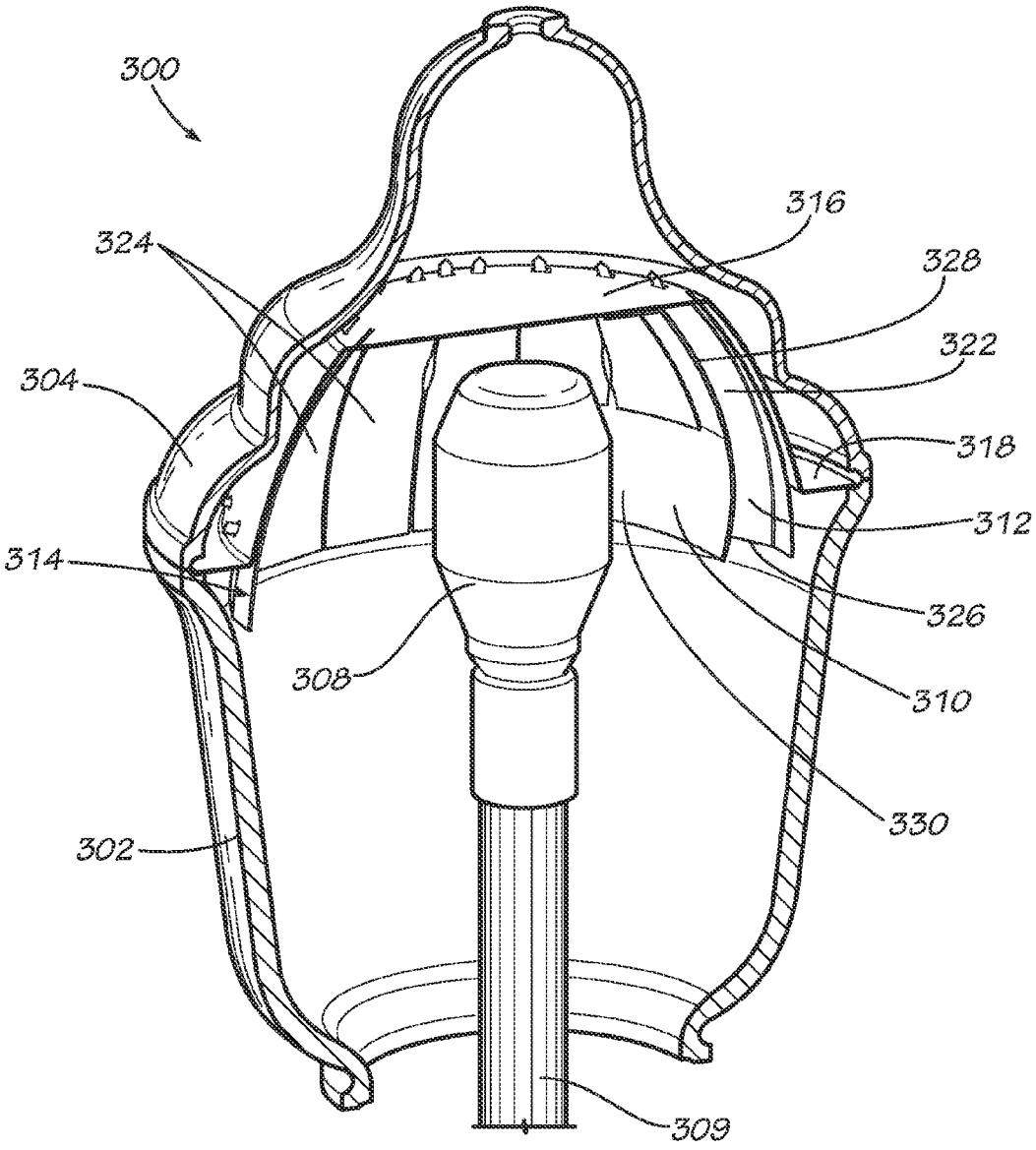
FIG. 11 is a perspective cut away view of one embodiment of the luminaire of FIG. 10.
Figure 12:
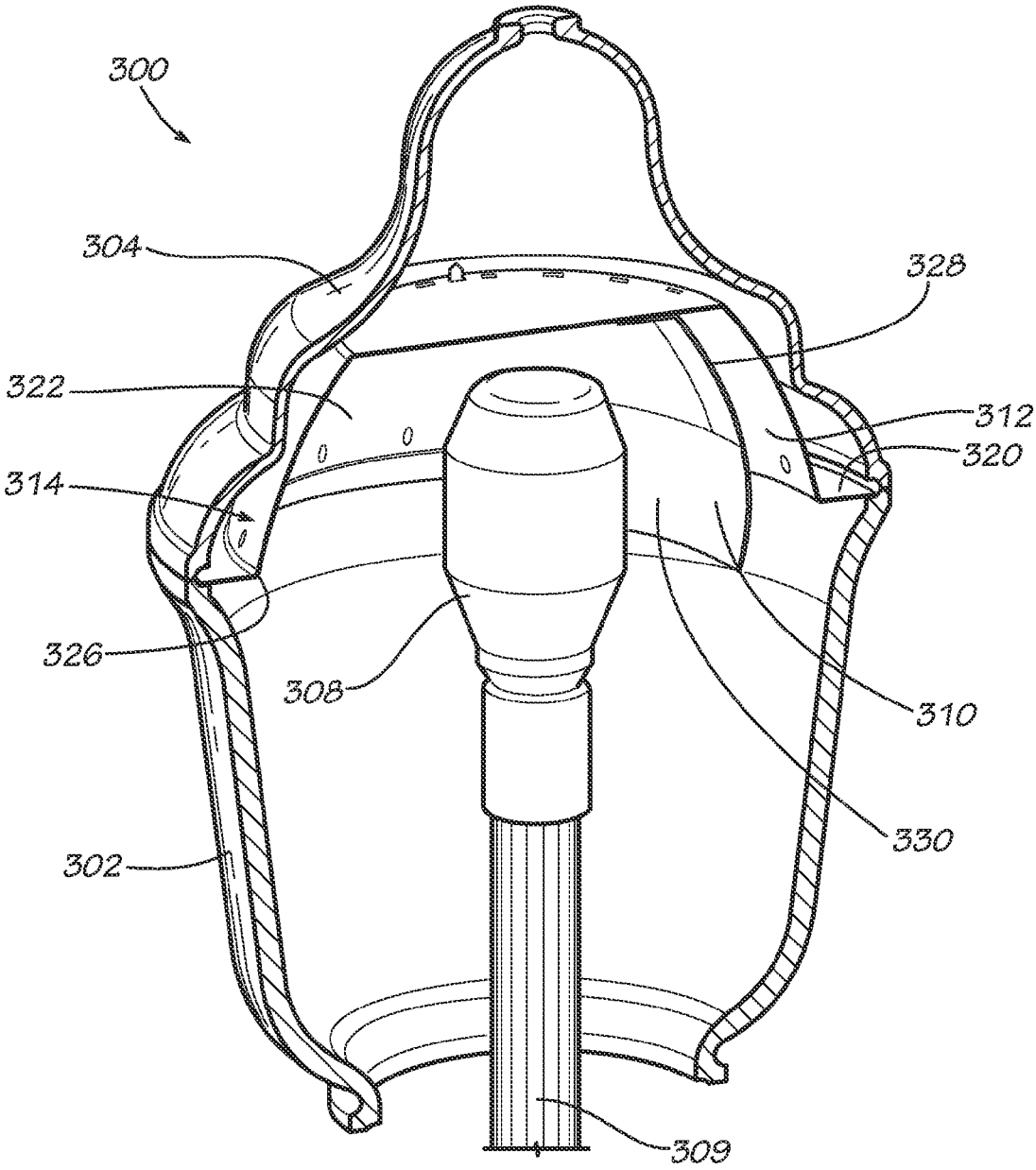
FIG. 12 is a perspective cut away view of an alternative embodiment of the luminaire of FIG. 10.

FIGS. 11 and 12 illustrate embodiments of luminaires provided with first and second inner optics (310, 312). In FIG. 11, the first and second inner optics (310, 312) are supported within the luminaire (300) via a mounting dome (316). At least one flange (318) extends from the dome (316) and seats within a recess formed at the junction of the top (304) and the outer optic (302). The second inner optic (312) is attached via any mechanical or chemical retention method to the dome (316) (e.g., screws, rivets, etc.). In an alternative embodiment, a dome (316) is not used. Rather, as shown in FIG. 12, a flange (320) is provided directly on the second inner optic (312) that seats within the recess formed at the junction between the top (304) and the outer optic (302).

In some embodiments, the second inner optic (312) is a reflector. The second inner optic can have any desired shape including, but not limited to, bell-shaped, parabolic, spherical or elliptical. In some embodiments wherein the second inner optic (312) is a reflector, the reflective surface (322) of the second inner optic (312) comprises a continuous reflective surface. In one embodiment, the reflective surface (322) of the second inner optic (312) comprises a plurality of continuous reflective panels (324) (see FIG. 11). The second inner optic (312) can extend partially or entirely around the light source (308).

The first inner optic (310) is preferably shaped and/or positioned within the luminaire (300) to direct light received from a point of maximum luminance of the light source (308) towards the bottom portion (314) of the second inner optic (312) proximate the bottom edge (326) of the second inner optic (312). The first inner optic (310) can be disposed at least partially within the second inner optic (312), although in embodiments where the second inner optic (312) does not extend entirely around the light source (308) this may not be the case. Moreover, while only one first inner optic (310) is shown, one of skill in the art will understand that multiple first inner optics may be used.

In one embodiment, the first inner optic (310) is supported within the luminaire (300) by an arm (328) that is attached to the mounting dome (316) (FIG. 11) or the second inner optic (312) (FIG. 12), such as by any mechanical retention means (e.g., screws, rivets, etc.). The arm (328) is of a length that preferably positions the first inner optic (310) within the luminaire (300) to receive light from a point of maximum luminance of the light source (308).

The first inner optic (310), in some embodiments, comprises a reflector. The reflective surface (330) of the first inner optic (310) is preferably, but not necessarily, largely specular in that it diffusely reflects less than 40% of the light that strikes the first inner optic (310) such that the directionality of at least 60% of the reflected light is controlled. The first inner optic (310) can have any desired shape consistent with the function of the first inner optic (310) as described herein. In some embodiments, the first inner optic (310) has a curved shape, including, but not limited to, bell-shaped, parabolic, spherical or elliptical. In one embodiment, the first inner optic (310) comprises an arc having a central angle of less than about 180°, less than about 90° or less than about 60°. In another embodiment, the first inner optic (310) comprises an arc having a central angle greater than 180°.

Reflective first and second inner optics (310, 312) can comprise any reflective material known to those of skill in the art as being suitable for use in reflective optics and the materials used in the first and second inner optics (310, 312) need not be the same. In one embodiment, a reflective material for use in the first and/or second inner optics (310, 312) comprises polished metals such as, but not limited to, polished aluminum. In some embodiments, a reflective material for use in the first and/or second inner optics (310, 312) comprises a high-reflectance pre-finished aluminum, such as MIRO 4. In some embodiments, the reflectivity of the first and/or second inner optics (310, 312) can be further enhanced by the application of reflective coatings, including reflective paints, or other reflective compositions.

Moreover, in some embodiments, reflective first and/or second inner optics (310, 312) comprise a protective covering over the reflective surfaces (322, 330) of the optics (310, 312). Protective coverings for the first and second inner optics (310, 312) can comprise any material that does not substantially impair the ability of the optics to perform their intended functions. In some embodiments, a protective covering comprises glass or polymeric materials. In one embodiment, a glass suitable for a protective covering comprises borosilicate glass.

Additionally, luminaires of the present invention contemplate any suitable light source known to one of skill in the art. In some embodiments, a light source comprises a HID lamp including metal halide lamps, high pressure sodium lamps, and mercury vapor lamps. In some embodiments, a HID lamp has any wattage up to 1000 W. In other embodiments, a HID lamp has a wattage greater than 1000 W. In another embodiment, a light source comprises a compact fluorescent lamp. In some embodiments, a compact fluorescent lamp has a wattage of 32 W, 42 W or 57 W.

As provided herein, the first inner optic (310) directs light received from a point of maximum luminance of the light source (308) to the bottom portion (314) of the second inner optic (312). In some embodiments, providing light received from a point of maximum luminance of the light source (308) to the bottom portion (314) of the second inner optic (312) increases the amount of high angle light distributed by the luminaire (300), thereby mitigating diminished illuminance at the periphery of an area illuminated by the luminaire (300).

Figure 13:
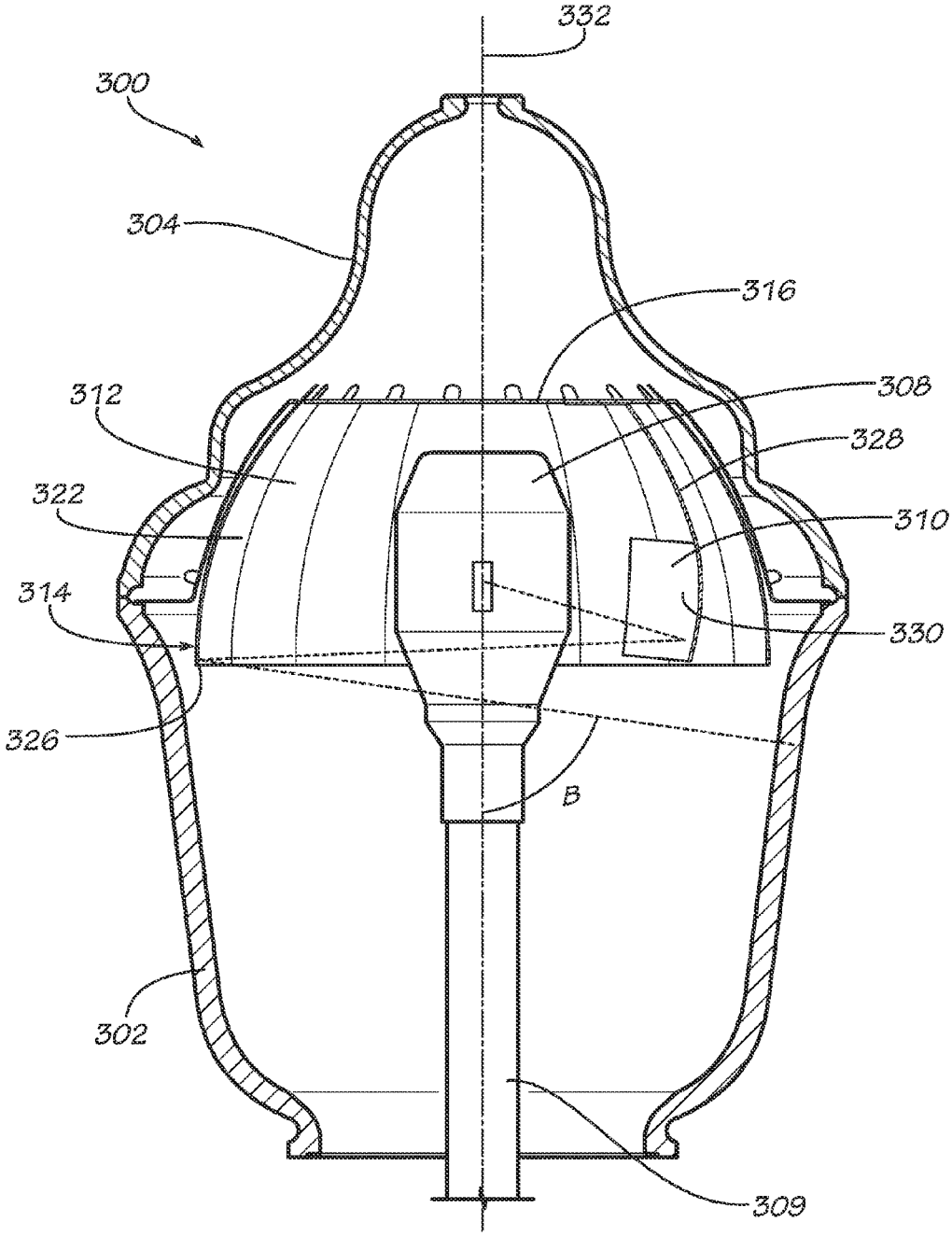
FIG. 13 is an elevational cut away view of the luminaire of FIG. 11 illustrating the first inner optic directing light to the second inner optic and the second inner optic directing light to the outer optic.

FIG. 13 illustrates the direction of the light emitted from the light source (308) within a luminaire (300) according to an embodiment of the invention. The reflective surface (330) of the first inner optic (310) receives light from the light source (308) and directs the light received from the light source (308) to the bottom portion (314) of the second inner optic (312). In some embodiments, at least 50% (and preferably more) of the controlled light (i.e., the specularly reflected light of the first inner optic (310)) and/or at least 30% of the total light received by the first inner optic (310) from the light source (308) strikes the reflective surface (322) of the second inner optic (312) proximate to the bottom edge (326) of the second inner optic (312). One of skill in the art will understand that procedures for measuring the percentage of light directed by the first inner optic (310) to the bottom portion (314) of the second inner optic (312) include computer simulations, luminance measurements, and goniophotometric measurements. Any controlled light reflected off of the first inner optic (310) that does not strike the second inner optic (312) escapes under the bottom edge (326) of the second inner optic (312).

The second inner optic (312), in turn, reflects at least most of the controlled light that strikes it towards the outer optic (302) at an angle β of at least 60° off of the nadir (332). Obviously, not all of the light will reflect at the same angle β from the second inner optic (312). The outer optic (302) spreads that light in the horizontal direction for distribution to a surface according to one embodiment of the present invention. Using the first inner optic (310) to direct light to the bottom portion (314) of the second inner optic (312) can increase the amount of high angle light provided by the luminaire (300). The increase in amount of high angle light can mitigate diminished illuminance at the periphery of an illuminated area.

In addition to providing luminaires, the present invention also provides methods of lighting a surface. In one embodiment, a method of lighting a surface comprises providing a luminaire (300) comprising a light source (308), an outer optic (302), and a first and second inner optic (310, 312) at least partially disposed within the outer optic (302), directing light received from a point of maximum luminance of the light source (308) by the first inner optic (310) to the bottom portion (314) of the second inner optic (312) and directing the light from the bottom portion (314) of the second inner optic (312) out of the luminaire (300) onto the surface.

Luminaires according to embodiments of the present invention can be used in a variety of applications. In some embodiments, luminaires of the present invention can be used in outdoor lighting applications, including roadway, parking lot, and sidewalk applications as well as athletic field and residential area applications. In other embodiments, luminaires of the present invention can be used in indoor lighting applications, including warehouse lighting and workspace lighting applications.

Various embodiments of the invention have been described in fulfillment of the various objectives of the invention. It should be recognized that these embodiments are merely illustrative of the principles of the present invention. Numerous modifications and adaptations thereof will be readily apparent to those of skill in the art without departing from the spirit and scope of the invention.

We claim:

1. A luminaire comprising:

a. a light source; and b. a first inner optic and a second inner optic, wherein:

i) the first inner optic comprises an inner reflective surface and an outer surface;

ii) the second inner optic comprises an outer surface, an inner reflective surface having a bottom portion, and a bottom edge;

iii) the inner reflective surface of the first inner optic is adapted to direct at least a first portion of light received from the light source onto the bottom portion of the inner reflective surface of the second inner optic proximate the bottom edge of the second inner optic; and iv) the inner reflective surface of the second inner optic is adapted to direct the first portion of light received from the first inner optic out of the luminaire.

2. The luminaire of claim 1, wherein the first inner optic is positioned to receive the light from a point of maximum luminance of the light source.

3. The luminaire of claim 1, wherein the first portion of light comprises at least 30% of the light received from the light source.

4. The luminaire of claim 1, wherein the inner reflective surface of the first inner optic is largely specular.

5. The luminaire of claim 1, wherein the first inner optic is at least partially positioned within the second inner optic.

6. The luminaire of claim 1, further comprising an outer optic.

7. The luminaire of claim 6, wherein the first and second inner optics are at least partially disposed within the outer optic.

8. The luminaire of claim 6, wherein the inner reflective surface of the second inner optic is adapted to direct the first portion of light received from the first inner optic towards the outer optic at an angle of at least 60° off of the nadir.

9. The luminaire of claim 8, wherein the outer optic comprises a refractor.

10. The luminaire of claim 9, wherein the refractor is adapted to spread the light received from the second inner optic substantially horizontally.

11. The luminaire of claim 6, wherein the outer optic comprises glass.

12. The luminaire of claim 6, further comprising a top that seats on the outer optic to enclose the first and second inner optics within the luminaire.

13. The luminaire of claim 12, further comprising a mounting dome having a flange that seats between the top and the outer optic to suspend the mounting dome within the luminaire, wherein the first and second inner optics are mounted to the mounting dome.

14. The luminaire of claim 13, wherein the first inner optic further comprises an arm that is mounted to the mounting dome.

15. The luminaire of claim 12, wherein the second inner optic further comprises a flange that seats between the top and the outer optic to suspend the second inner optic within the luminaire, wherein the first inner optic is mounted to the second inner optic.

16. The luminaire of claim 15, wherein the first inner optic further comprises an arm that is mounted to the second inner optic.

17. The luminaire of claim 1, wherein the inner reflective surface of the first inner optic is adapted to direct a second portion of the light received from the light source under the bottom edge of the second inner optic.

18. The luminaire of claim 1, wherein the inner reflective surface of the second inner optic comprises a plurality of reflective panels.

19. The luminaire of claim 1, wherein the inner reflective surface of the second inner optic is adapted to direct the first portion of light received from the first inner optic out of the luminaire at an angle of at least 60° off of the nadir.

20. The luminaire of claim 1, wherein the inner reflective surface of the second inner optic is adapted to receive a second portion of light directly from the light source.

21. A luminaire comprising:

a. a light source;

b. a refractive outer optic; and c. a first inner optic and a second inner optic at least partially disposed within the outer optic, wherein:

i) the first inner optic comprises a largely specular inner reflective surface and an outer surface;

ii) the second inner optic comprises an outer surface, an inner reflective surface having a bottom portion, and a bottom edge;

iii) the inner reflective surface of the first inner optic is adapted to direct at least 30% of light received from the light source onto the bottom portion of the inner reflective surface of the second inner optic proximate the bottom edge of the second inner optic; and iv) the inner reflective surface of the second inner optic is adapted to direct at least some of the light received from the first inner optic towards the outer optic at an angle of at least 60° off of the nadir.

22. A method of lighting a surface comprising:

a) providing a luminaire comprising a light source, a first inner optic and a second inner optic, wherein:

i) the first inner optic comprises an inner reflective surface and an outer surface; and ii) the second inner optic comprises an outer surface, an inner reflective surface having a bottom portion, and a bottom edge;

b) directing light from the light source to the inner reflective surface of the first inner optic;

c) directing at least a portion of the light from the inner reflective surface of the first inner optic onto the bottom portion of the inner reflective surface of the second inner optic proximate the bottom edge of the second inner optic; and d) directing the portion of the light received from the first inner optic out of the luminaire.

* * * * *